US008276984B1

(12) United States Patent
Jamison, Jr.

(10) Patent No.: US 8,276,984 B1
(45) Date of Patent: Oct. 2, 2012

(54) FURNITURE ASSEMBLY

(75) Inventor: Clark Benjamin Jamison, Jr., Houston, TX (US)

(73) Assignee: Christopher Welch, Soddy Daisy, TN (US)

( * ) Notice: Subject to any disclaimer, the term of this patent is extended or adjusted under 35 U.S.C. 154(b) by 229 days.

(21) Appl. No.: 12/256,193

(22) Filed: Oct. 22, 2008

(51) Int. Cl.
*A47B 85/04* (2006.01)

(52) U.S. Cl. ..... 297/126; 297/119; 297/122; 297/124; 297/125

(58) Field of Classification Search ..... 297/119, 297/120, 122, 124, 452.4, 125, 126
See application file for complete search history.

(56) References Cited

U.S. PATENT DOCUMENTS

| | | | | | |
|---|---|---|---|---|---|
| 312,020 | A | | 2/1855 | Sawyer | |
| 203,605 | A | | 5/1878 | Eastman | |
| 398,693 | A | | 2/1889 | Bittle | |
| 918,706 | A | | 4/1909 | Sanders | |
| 1,197,359 | A | * | 9/1916 | Evans | 297/109 |
| 1,307,420 | A | * | 6/1919 | Schimdt | 297/124 |
| 1,335,973 | A | * | 4/1920 | Kesselman | 297/107 |
| 1,449,436 | A | * | 3/1923 | Neill | 297/146 |
| 1,817,708 | A | * | 8/1931 | Pintow | 297/110 |
| 1,926,915 | A | * | 9/1933 | Ramirez | 297/109 |
| 2,337,955 | A | | 12/1943 | Wright | |
| 3,504,940 | A | * | 4/1970 | Friese | 297/105 |
| 3,972,562 | A | * | 8/1976 | Montrose | 297/359 |
| 5,380,034 | A | * | 1/1995 | Wilson | 280/657 |
| 5,647,632 | A | | 7/1997 | Fireman | |
| 5,669,658 | A | | 9/1997 | Liles | |
| 6,033,026 | A | * | 3/2000 | Tseng | 297/452.4 |

* cited by examiner

*Primary Examiner* — David Dunn
*Assistant Examiner* — Philip Gabler
(74) *Attorney, Agent, or Firm* — Michael R. Schacht; Schacht Law Office, Inc.

(57) ABSTRACT

A furniture assembly maneuverable from a first position to a second position has a first seat portion having a channel formed in an end thereof, a second seat portion positioned below the first seat portion, a first back portion positioned adjacent the end of the first seat portion, and a second back portion having a front surface positioned adjacent a back surface of the first back portion when in the first position. The second seat portion has legs extending from a bottom surface thereof adjacent a side thereof. The second seat portion has legs extending from the bottom surface thereof adjacent an opposite side thereof. The first back portion has keyholes on the back surface thereof. The second back portion has mushrooms on the front surface thereof. The mushrooms are removably placed in the keyholes when the first position.

13 Claims, 6 Drawing Sheets

FURNITURE ASSEMBLY

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to furniture that can be converted from a first to a second position. More particularly, the present invention relates to furniture that is a chair when in the first position and a bed when in the second position. Additionally, the present invention relates to furniture that is a sofa when in the first position and a bed when in the second position.

2. Description of Related Art Including Information Disclosed Under 37 CFR 1.97 and 37 CFR 1.98.

Furniture is common in both residential and commercial buildings. Common pieces of furniture include chairs, sofas and beds. Furniture is selected according to the function of the room and according to the style of the room. For example, if the room is to be used for discussions and gatherings, then chairs and sofas may be selected as the furniture items for the room. If the room is to be used for sleeping, then beds are usually selected as the furniture items in the room. Sometimes rooms can be used for both socializing and sleeping. Thus, there is a need to have both a chair and a bed, or a sofa and a bed, in the same room.

One problem associated with furniture items in rooms is that rooms are not large enough to accommodate both a chair and a bed or both a sofa and a bed. Thus, there is a need for a single piece of furniture that functions as both a chair and a bed or both a sofa and a bed.

Various patents have issued relating to convertible furniture. For example, U.S. Pat. No. 5,647,632, issued on Jul. 15, 1997 to Fireman, discloses a convertible chair that has a base platform, a ground support coupled to the platform, and a seat assembly pivotally connected to the base platform. The base platform has an upper surface, a first edge portion, and a spaced pair of edge portions intersecting the first edge portion. The seat assembly has a seat member and a seat back member coupled to the seat member. The seat member has respective upper and lower surfaces. The seat assembly moves between a chair-forming first position in which the lower surface of the seat member overlies and is juxtaposed to the upper surface of the base platform, and a second position in which the lower surface of the seat member and the upper surface of the base platform are generally coplanar so as to form a bench surface.

U.S. Pat. No. 1,817,708, issued on Aug. 4, 1931 to Pintow, discloses a chair that has a main seat frame, supporting legs, a cushion carried by the frame, a second seat frame hingedly associated with an end of the main frame, and aback seat frame hingedly mounted to the opposite end of the main frame. The complemental frame has arms adapted for supporting the complemental frame when the frame is disposed in a horizontal position. The complemental frame has a cushion that is adapted to operate with the cushion of the main seat frame to provide a flat-supporting surface when the complemental seat frame is disposed in a horizontal position. A cushion member is carried by the back frame. A hinged fabric connection extends between the cushion of the back frame and the cushion of the main seat frame.

U.S. Pat. No. 2,337,955, issued on Dec. 28, 1943 to Wright, discloses a folding article of furniture that has at least four rectangular frame sections that are pivotally connected together, a pair of legs pivotally connected to the free end of one of the sections, and a second pair of legs pivotally connected to another of the sections to support the other end of the frame. The four rectangular frame sections are arranged to be folded together and to be extended in an unfolded position, with the sections all lying substantially in a common plane. One of the sections is independently adjustable to form the back of the chair. Another section is adjacent to the arm section so as to form the seat for the chair. The remainder of the sections are foldable with respect to the section so that the first pair of legs extend downwardly from a front of the seat section and serve as the front legs of the chair.

U.S. Pat. No. 1,926,915, issued on Sep. 12, 1933 to Ramirez, discloses a chair frame having front legs and back legs. The back legs extend upwardly and support the head piece. A seat portion is hinged to the frame and has arms attached thereto. A footpiece is pivoted to the seat portion and has a footboard pivoted thereto. Supporting legs hingedly connect to the footpiece and adapt to support the foot portion when in an extended position. Beveled shoulders are formed on the back legs. The arms lie upon the frame and abut the shoulders when in the folded position. The pivoted edge of the footpiece rests upon the shoulders. The foot board rests upon the upper edge of the head piece. The supporting legs and foot board lie flush against opposite sides of the footpiece.

U.S. Pat. No. 1,197,359, issued on Sep. 5, 1916 to Evans, discloses a chair and couch that has a stationary section having a fixed elevation, an intermediate section, and an end section. The intermediate section has supporting legs. The end section has foldable supporting legs. The stationary section has links connected thereto. The links are also connected to the intermediate section. Other links connect the intermediate section to the end section. The links support the intermediate section by a distance equal to their length in spaced relation above the stationary section and the end section. The links are foldable between the intermediate section and the stationary section. A mattress supporting spring is conjointly carried by the several sections and their connecting links. The mattress is foldable therewith.

U.S. Pat. No. 398,693, issued on Feb. 26, 1889 to Bittle, discloses a folding chair having a pivoted back and a frame. Arms are pivoted at the rear ends to the back and at their front ends are slidingly engaged to the frame of the chair. A brace is pivoted at its lower end to a leg. The brace is pivotally connected between its ends to the arms and engages the back so as to support the arms.

U.S. Pat. No. 918,706, issued on Apr. 20, 1909 to Sanders, discloses a folding chair that has a base with legs attached thereto, a seat pivotally connected at a front edge to a front edge of the base, a backrest adapted to act as support to the seat when the seat is extended in the same plane as the base, a yoke piece hinged to the rear edge of the base and adapted to engage a projection on the seat, and an extension bar on underside of the base that is connected and actuated by the yoke piece.

U.S. Pat. No. 312,020, issued on Feb. 10, 1855 to Sawyer, discloses a convertible chair that has a section, and a back hinged to the section. The seat section is recessed. The back has a latch, a recess, and a lever. The latch is pivoted relative to the seat section.

U.S. Pat. No. 203,605, issued on May 14, 1878 to Eastman, discloses an improved cot, lounge, and chair that has a first section pivotally connected to a second section and a third section pivotally connected to the second section. The sections pivot relative to one another so as to form a chair or abed. Legs extend from a bottom surface of the first section. Legs extend from a bottom surface of the second section. A first pair of legs extend downwardly from a bottom section of the third section adjacent the end of the third section. A second pair of legs extend downwardly from the bottom surface of the third section adjacent an opposite end of the third section. A brace is connected to the first pair of legs of the third section. Another brace is connected to the second pair of leg of the third section. A brace is connected to the legs of the second section. A brace is connected to the legs of the first section. A brace connects the legs of the second section with the first section.

U.S. Pat. No. 3,504,940, issued on Apr. 7, 1970 to Friese, discloses a convertible seat made of three frame sections and a cushion that are pivotally secured to each other. The services that are used from the seat are different from those surface used as a bed, and thereby avoid double duty on a single surface. One surface can be upholstered to resemble a seat and other surface can be upholstered to resemble a bed. A bolster is shaped to serve as a back rest for the seat when used in the seating position. The bolster doubles as a comfortable head rest when used in the bed position.

U.S. Pat. No. 5,669,658, issued on Sep. 23, 1977 to Liles, discloses a convertible table and support characterized by a support which is pivotally mounted on a support frame and reversibly pivoted from an upright sitting position resting on the support frame to an inverted position adjacent to the support frame so as to define a bench and table combination. The support is characterized by a seat which rests on the support frame when the support is in the upright sitting position. A backrest extends upwardly from the rear edge of the seat. A pivoting arm extends from each side of the seat adjacent to the front edge thereof and is pivotally mounted between respective support frame arms that extend upwardly from the support frame. When the support is in the inverted or table position, the horizontally-oriented seat is supported by the support frame and the backrest. The horizontally-oriented seat functions as a table top. The support frame defines a bench.

It is an object of the present invention to provide a furniture assembly that changes from a chair to a bed.

It is another object of the present invention to provide a furniture assembly that changes from a sofa to a bed.

It is another object of the present invention to provide a furniture assembly that can disassemble into sub assemblies that are easily handled.

It is still another object of the present invention to provide a furniture assembly that requires no tools to rearrange the assembly into different positions.

It is another object of the present invention to provide a furniture assembly that easily-assembled into sub assemblies.

It is another object of the present invention to provide a furniture assembly that is sturdy and secure in any position.

It is another object of the present invention to provide a furniture assembly that can be compactly shipped in a small box.

It is another object of the present invention to provide a furniture assembly that is easily assembled.

It is another object of the present invention to provide a furniture assembly where the chair in the first position is the same width as the bed in the second position.

It is still another object of the present invention to provide a furniture assembly where the sofa in the first position is the same width as the bed in the second position.

It is another object of the present invention to provide a furniture assembly that can be made of any material.

It is another object of the present invention to provide a furniture assembly that has an adjustable width through telescoping components.

These and other objects and advantages of the present invention will become apparent from a reading of the attached specification and appended claims.

BRIEF SUMMARY OF THE INVENTION

The present invention is a furniture assembly maneuverable from a first position to a second position comprising a first seat portion having a channel formed in an end thereof, a second seat portion positioned below the first seat portion, a first back portion positioned adjacent the end of the first seat portion, and a second back portion having a front surface positioned adjacent a back surface of the first back portion when in the first position. The second seat portion has a first plurality of legs extending from a bottom surface thereof adjacent a side thereof. The second seat portion has a second plurality of legs extending from the bottom surface thereof adjacent an opposite side thereof. The first back portion is received in the channel of the first seat portion when in the first position.

The first back portion has a plurality of keyholes formed in the back surface thereof. The second back portion has a plurality of mushrooms extending from the front surface thereof. The plurality of mushrooms are removably placed in the plurality of keyholes when the first and second back portions are in the first position. Each of the plurality of mushrooms comprises a base member positioned adjacent the front surface of the second back portion, a shaft extending outwardly from the base member, and a cylindrical member positioned adjacent an end of the shaft opposite the base member. The cylindrical member has a diameter greater than a diameter of the shaft. Each of the plurality of keyholes comprises a base structure positioned adjacent the back surface of the first back portion, and a hole formed in the base structure. The hole has a first portion and a second portion. The first portion has a diameter substantially similar to the diameter of the cylindrical member. The second portion has a diameter substantially similar to the diameter of the shaft. The first portion is positioned above the second portion.

The second seat portion has a first pair of projections adjacent an end of the second seat portion. The second seat portion has a second pair of projections adjacent an opposite end of the second seat portion. The first and second pair of projections extend upwardly from a top surface of the second seat portion. The first pair of projections has a distance from the end of the second set portion that is less than a distance of the second pair of projections from the opposite end of the second set portion. The first back portion has a pair of holes formed in a top thereof. The pair of holes of the first back portion receive the first pair of projections when in the second position. The second back portion has a pair of holes formed in a top thereof. The pair of holes of the second back portion receive the second pair of projections when in the second position.

The first back portion has a first indentation formed in a bottom surface thereof adjacent the end thereof. The first seat portion has a second indentation formed in the bottom surface thereof adjacent an opposite end thereof. The first back portion has an indentation formed in the back surface thereof adjacent a top thereof. The second back portion has an indentation formed in a back surface thereof adjacent a top thereof. The first indentation is adjacent the indentation of the first back portion when in the second position. The second indentation is adjacent the indentation of the second back portion when in the second position.

The first plurality of legs have a leg adjacent the end of the second seat portion. The leg of the first plurality of legs has a stopper on a side thereof. The second plurality of legs has a leg adjacent the end of the second seat portion. The leg of the second plurality of legs has a stopper on a side thereof. The stopper of the first plurality of legs faces the stopper of the second plurality of legs. The stopped of the first plurality of legs and the stopper of the second plurality of legs are adjacent an overhang of the first back portion when in the first position. A notched part is mounted adjacent the overhang.

A pair of arms extend outwardly from a front surface of the first back portion. A leg extends outwardly from the front surface of the first back portion adjacent a bottom thereof. Another leg extends outwardly from the front surface of the second back portion adjacent a bottom thereof. The leg of the first back portion is above the other leg of the second back portion when in the first position.

The first and second seat portions and said first and second back portions are suitable for telescoping in a lateral direction so as to increase a width of said first and second seat portions and said first and second back portions.

DETAILED DESCRIPTION OF THE INVENTION

Figure 1:
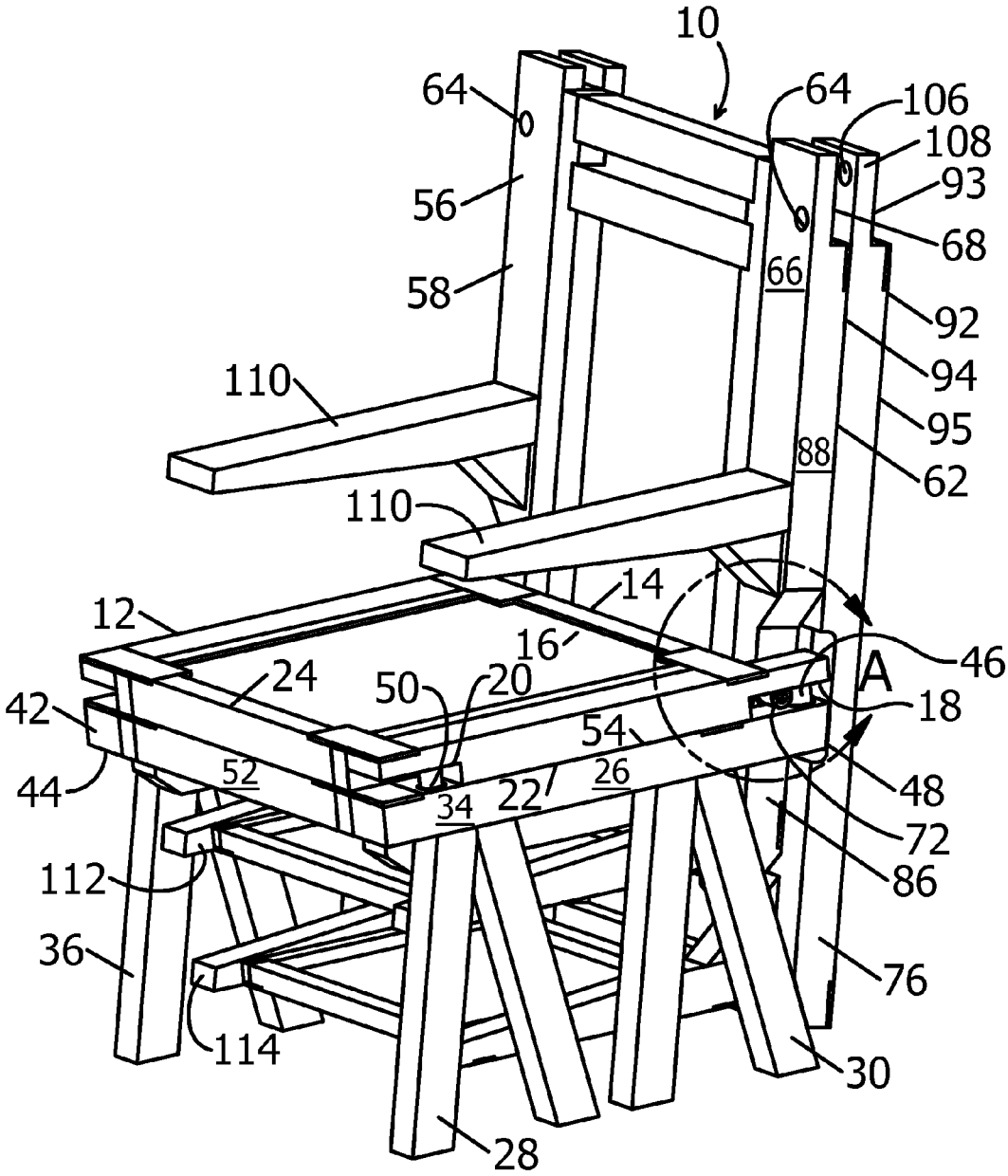
FIG. 1 shows a perspective view of the preferred embodiment of the furniture assembly of the present invention in the first position.

Referring to FIG. 1, there is shown a perspective view of the preferred embodiment of the furniture assembly 10 of the present invention in the first position. The furniture assembly 10 is movable from a first position to a second position. The furniture assembly 10 has a first seat portion 12 that has a channel 14 in an end 16 thereof. A second seat portion 26 is positioned below the first seat portion 12. The second seat portion 26 has a first plurality of legs 28 extending from a bottom surface 44 thereof adjacent a side 34 thereof. The second seat portion 26 also has a second plurality of legs 36 extending from the bottom surface 44 thereof adjacent an opposite side 42 thereof. A first back portion 56 is positioned adjacent the end 16 of the first seat portion 12. The first back portion 56 is received in the channel 14 of the first seat portion 12 when in the first position. A second back portion 92 has a front surface 94 that is positioned a back surface 62 of the first back portion 56 when in the first position. The first back portion 56 has a plurality of keyholes formed in the back surface 62 thereof. The second back portion 92 has a plurality of mushrooms extending from the front surface 94 thereof. The plurality of mushrooms are removably replaced in the plurality of keyholes when the first and second back portions 56 and 92 are in the first position. The mushrooms and keyholes are described in detail in FIGS. 5-9.

The second seat portion has a first pair of projections 46 adjacent an end 48 of the seat portion 26. The second seat portion 26 has a second pair of projections 50 adjacent an opposite end 52 of the second seat portion 26. The first back portion 56 has a pair of holes 64 formed in a top 66 thereof. The pair of holes 64 of the first back portion 56 receive the first pair of projections 46 when in the second position. The second back portion 92 has a pair of holes 106 formed in the top 108 thereof. The pair of holes 106 of the second back portion 92 receives the second pair of projections 50 when in the second position.

The first back portion 56 has a first stopper 72 extending from a side 88 thereof. A second stopper extends from an opposite side of the first back portion 56. The first stopper 72 and the second stopper are positioned adjacent a top surface 54 of the second seat portion 26.

The first seat portion 12 has a first indentation 18 formed in a bottom surface 22 thereof adjacent an end 16 thereof. The first seat portion 12 has a second indentation 20 formed in the bottom surface 22 adjacent an opposite end 24 thereof. The first back portion 56 has an indentation 68 formed in the back surface 62 thereof adjacent a top 66 thereof. The second back portion 92 has an indentation 93 formed in a back surface 95 thereof adjacent a top 108 thereof. The first indentation 18 of the first seat portion 12 is adjacent the indentation 68 of the first back portion 56 when in the second position. The second indentation 20 of the first seat portion 12 is adjacent the indentation 93 of the second back portion 92 when in the second position.

The first plurality of legs 28 have a leg 30 that is adjacent the end 48 of the second seat portion 26. The leg 30 of the first plurality of legs 28 has stopper on a side thereof. The second plurality of legs 36 has a leg adjacent the end 48 of the second seat portion 26. The leg of the second plurality of legs 36 has a stopper on the side thereof. The stoppers of the legs are described in more detail in FIGS. 2 and 4.

A pair of arms 100 extend outwardly from the front surface 58 of the first back portion 56. A leg 112 extends outwardly from the front surface 58 of the first back portion 56 adjacent a bottom 86 thereof. Another leg 114 extends outwardly from the front surface 94 of the second back portion 92 adjacent the bottom 76 thereof. The leg 112 of the first back portion 56 is above the other leg 114 of the second back portion 92 when in the first position.

Figure 2:
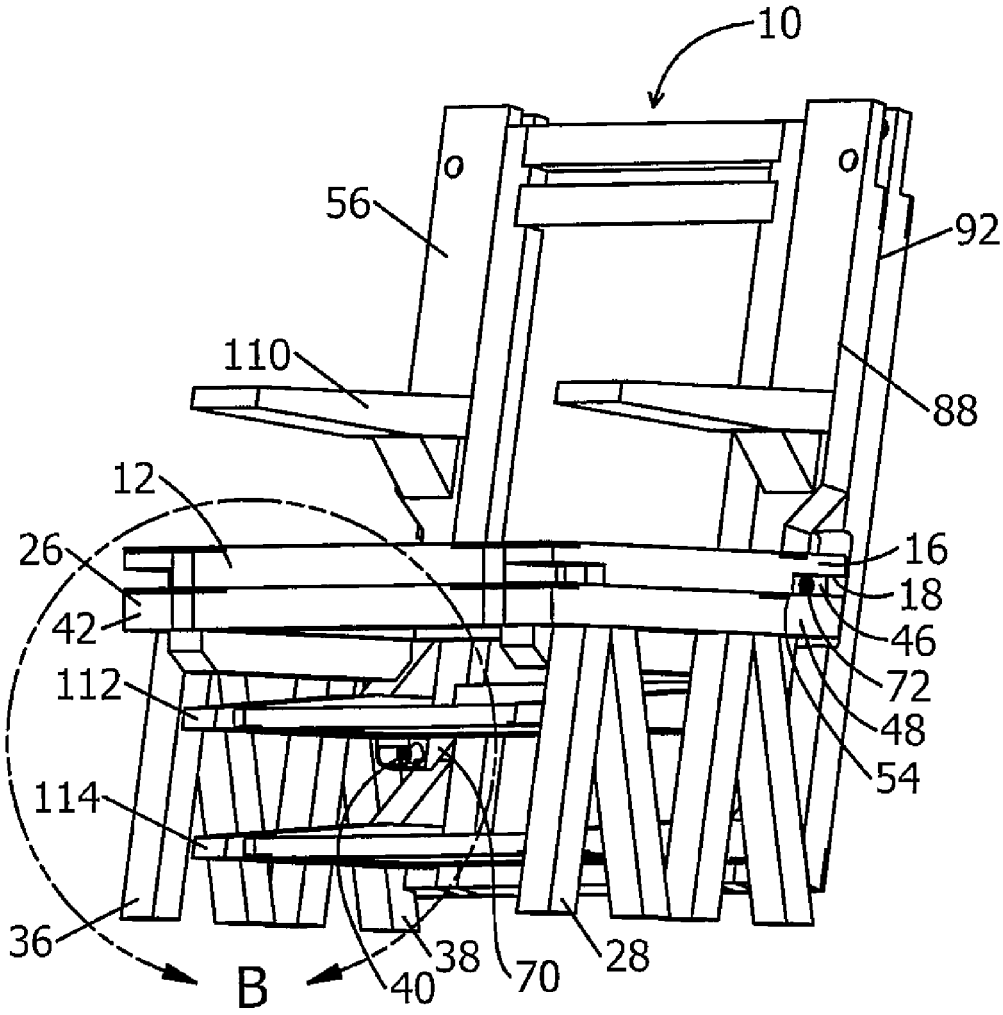
FIG. 2 shows another perspective view of a preferred embodiment of the furniture assembly of the present invention in the first position.

Referring to FIG. 2, there is shown another perspective view of a preferred embodiment of the furniture assembly 10 of the present invention in the first position. Stopper 40 can be seen as attached to leg 38 of the second plurality of legs 36. The second plurality of legs 36 is attached to the opposite side 42 of the second seat portion 26. The stopper of the first plurality of legs and the stopper 40 of the second plurality of legs 36 are adjacent an overhang 70 of the first back portion 56 when in the first position. The stopper 40 resists a forward force of the overhang 70 so that the first back portion 56 does not rotate from its substantially vertical orientation in the first position. The stopper 72 of the first back portion 56 rests on the top surface 54 of the second seat portion 26. The stopper 72 holds the first back portion 56 in place so that the first back portion 56 does not move up and down while in the first position. Thus, the stoppers of the second seat portion 26 and the stoppers of the first back portion 56 hold the first back portion 56 relative to the second seat portion 26 so as to maintain furniture assembly 10 in the first position.

Figure 3:
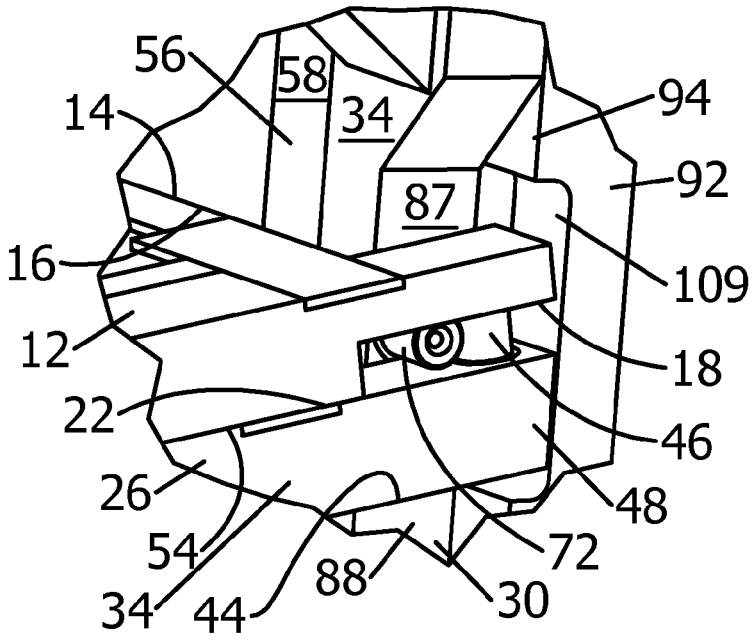
FIG. 3 shows a close-up perspective view of circled portion A shown in FIG. 1.

Referring to FIG. 3, there is shown a close-up perspective view of the circled portion A shown in FIG. 1. The relationship between the first stopper 72 on the side 88 of the first back portion 56 and the projection 46 on the top surface 54 of the second seat portion 26 can be seen. When in the first position, both the stopper 72 and the projection 46 reside within the indentation 18 that is formed in the bottom surface 22 of the first seat portion 12. The stopper 72 is cylindrical in shape. The projection 46 is also cylindrical in shape. The longitudinal axis of the stopper 72 is perpendicular to the longitudinal axis of the projection 46. The first back portion 56 has a concave portion 87 that tapers inwardly of the side 88 of the first back portion 56. The concave portion 87 allows the end 16 of the first seat portion 12 to extend past the first back portion 56 and reside in the divot 109 that is formed in the front surface 94 of the second back portion 92. The unique carving of the concave portion 87 and the divot 109 allow the first and second back portions 56 and 92 to be received by the channel 14 of the first seat portion 12. The stopper 72 is between the top surface 54 of the second seat portion 26 in the first indentation 18 of the first seat portion 12. The indentation 18 and the top surface 54 are adjacent to the stopper 72 so as to prevent the stopper from moving upward or downward. The projection 46 is adjacent the stopper 72 so as to prevent the stopper 72 from sliding out of the indentation 18 when the furniture assembly 10 is in the first position.

Figure 4:
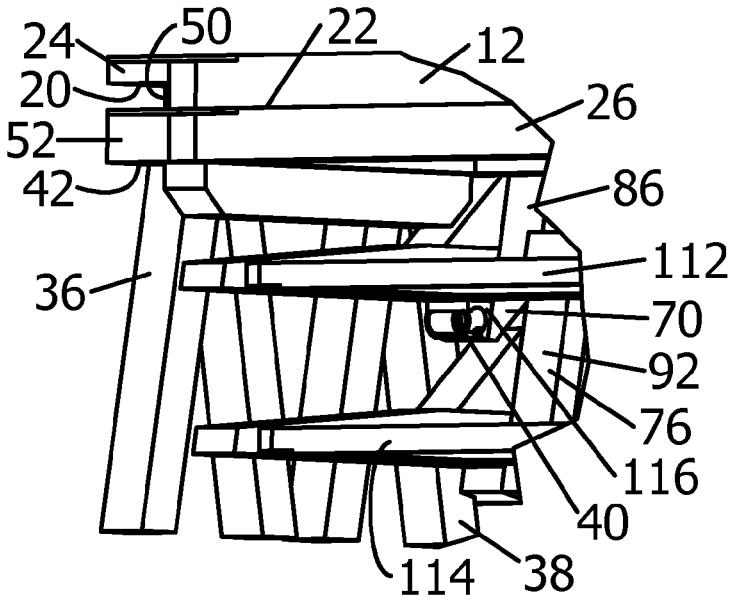
FIG. 4 shows a close-up perspective view of the circled portion B in FIG. 2.

Referring to FIG. 4, there is shown a close-up perspective view of the circled portion B in FIG. 2. The relationship of the stopper 40 of leg 38 of the second plurality of legs 36 with the overhang 70 of the first back portion 56 can be seen. The overhang 70 extends past the leg 112 of the first back portion 56. The stopper 40 is cylindrical in shape. The stopper 40 extends inwardly from the side of the leg 38. A notched part 116 is attached to the overhang 70. The notched part 116 receives the stopper 40. Particularly, the notched part 116 is formed so as to have an arcuate receiving area that suitably receives the cylindrically-shaped stopper 40. The notched part 116 can be made of any material suitable for receiving the stopper, including aluminum. Once received in the notched part 116, the stopper 40 prevents the overhang 70, and thus the first back portion 56 from moving backwards and forwards when the furniture assembly 10 is in the first position. The leg 112 of the first back portion 56 can be seen as above the leg 114 of the second back portion 92 as located adjacent the bottom 76 of the second back portion 92.

Figure 5:
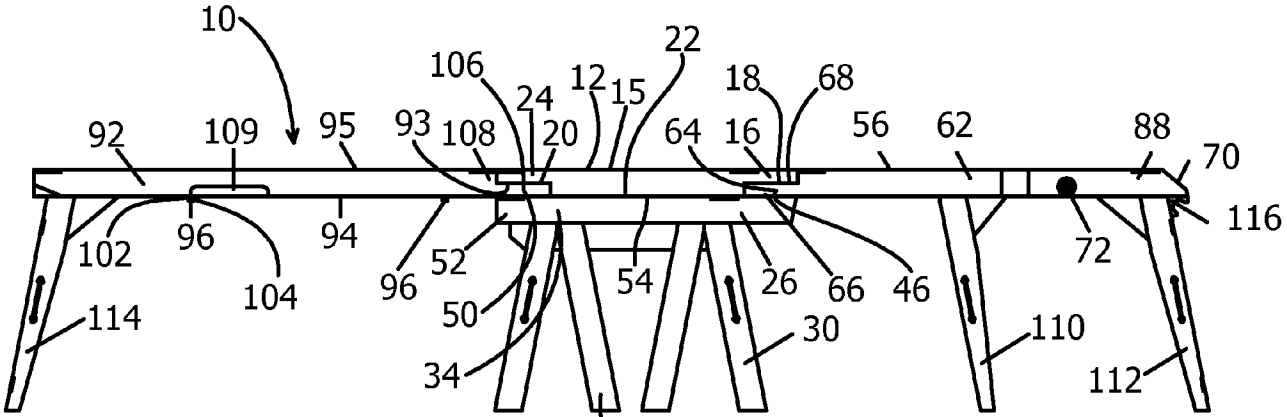
FIG. 5 shows a side elevational view of the preferred embodiment of the furniture assembly of the present invention in the second position.

Referring to FIG. 5, there is shown a side elevational view of the furniture assembly 10 of the present invention in the second position. Leg 114 extends downwardly from the second back portion 92. Leg 112 extends downwardly from the first back portion 56. Arm 110 extends downwardly from the first back portion 56. The first plurality of legs 28 extends downwardly from the second seat portion 26. The mushrooms 96 of the second back portion 92 can be seen. As will be described in more detail in FIGS. 7-9, each mushroom 96 has a shaft 100 and a cylindrical member 104. Each mushroom 96 extends outwardly from the front surface 94 of the second back portion 92. The divot 109 of the second back portion 92 can be seen. When in the first position, the divot 109 receives the end 16 of the first seat portion 12. In the second position, as shown in FIG. 5, the divot 109 receives nothing. The divot 109 is adjacent one of the mushrooms 96. The divot 109 is between two of the mushrooms 96. The indentation 68 and the top 66 of the first back portion 56 is received by the indentation 18 of the first seat portion 12. The hole 64 that if formed in the top 66 of the first back portion 56 receives the projection 46 of the second seat portion 26. The end 16 of the first seat portion 12 exerts a downward force on the top 66 of the first back portion 56 so as to keep the projection 46 within the hole 64. The indentation 93 in the top 108 of the second back portion 92 is received by the indentation 20 on the opposite end 24 of the first seat portion 12. The hole 106 formed in the top 108 of the second back portion 92 receives the projection 50 that extends upwardly from the top surface 54 of the second seat portion 26 adjacent an opposite end 52 of the second seat portion 26. The opposite end 24 of the first seat portion 12 exerts a downward force on the top 108 of the second back portion 92 so as to keep the projection 50 within the hole 106. The leg 114 of the second back portion 92, the leg 112 of the first back portion 56, the arm 110 of the first back portion 56, and the plurality of legs 28 of the second seat portion 26 extend downwardly so that the furniture assembly 10 is horizontally level when in the second position. The back surface 95 of the second back portion 92, the back surface 62 of the first back portion 56 and the top surface 15 of the first seat portion 12 are planar with one another when in the second position. The notched part 116 can be seen adjacent leg 112 and the overhang 70.

Figure 6:
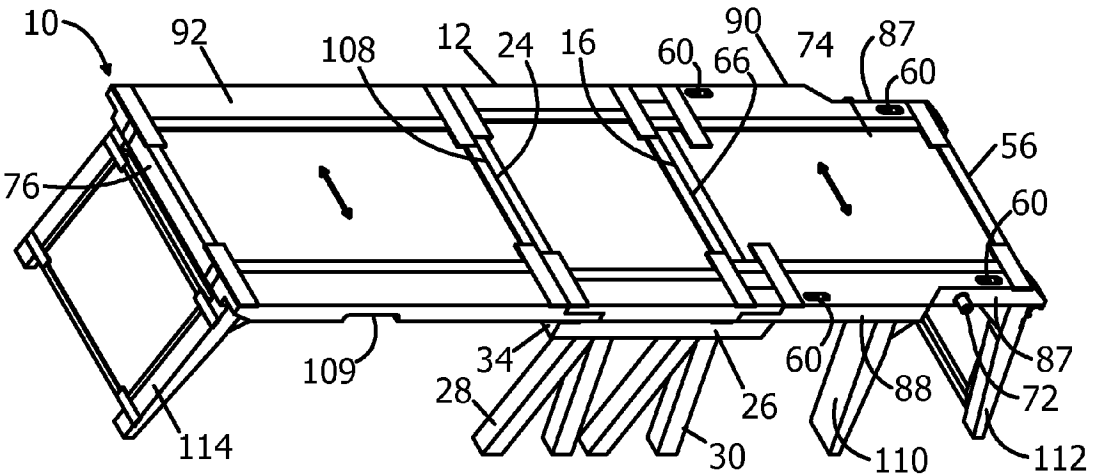
FIG. 6 shows a perspective view of the furniture assembly of the present invention in the second position.

Referring to FIG. 6, there is shown a perspective view of the furniture assembly 10 of the present invention in the second position. The keyhole 60 can be seen as placed on the back surface 62 of the first back portion 56. As can be seen, there is a concave portion 87 on side 88 and on opposite side 90 of the first back portion 56. The first stopper 72 can be seen as extending outwardly from the concave portion 87 on side 88. The second stopper 74 of the first back portion 56 can be seen as extending outwardly from the concave portion 87 on opposite side 90.

The first and second seat portions 12 and 26 and the first and second back portions 56 and 92 can be suitable for telescoping in the lateral direction. The lateral direction is indicated by the arrows in FIG. 6. Telescoping in a lateral direction allows the furniture assembly 10 to increase the width of the first and second seat portions 12 and 26 and the first and second back portions 56 and 92.

Figure 7:
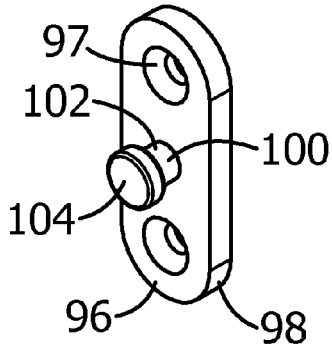
FIG. 7 shows an isolated perspective view of the mushroom of the present invention.

Referring to FIG. 7, there is shown an isolated perspective view of one of the mushrooms 96 of the present invention. The mushrooms 96 are placed on the front surface 94 of the second back portion 92. Each mushroom 96 has a base member 98 positioned adjacent the front surface 94 of the second back portion 92. A shaft 100 extends outwardly from the base member 98. A cylindrical member 104 is positioned adjacent an end 102 of the shaft 100 opposite the base member 98. The cylindrical member 104 has a diameter greater that a diameter of the shaft 100. The base member 98, shaft 100, and cylindrical member 104 can be integrally formed. A notch can be placed in the front surface 94 of the second back portion 92 so as to place the base member 98 in the front surface 94. The base member 98 can be attached to the second back portion 92 by using screws inserted through screw holes 97 that are formed in the base member 98. Alternatively, the base member 98 can be integrally formed with the front surface 94 of the second back portion 92, and the shaft 102 and cylindrical member 104 can be attached to the base member 98 by a method known to someone of ordinary skill in the art, such as by gluing or screwing.

Figure 8:
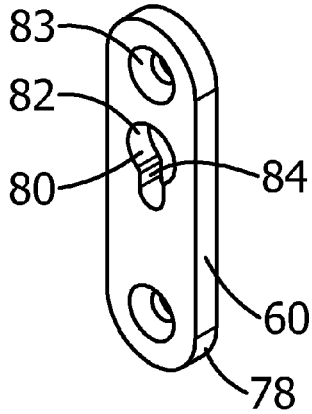
FIG. 8 shows an isolated perspective view of the keyhole of the present invention.

Referring to FIG. 8, there is shown an isolated perspective view of one of the keyholes 60 that is used on the back surface 62 of the first back portion 56. Each of the keyholes 60 has a base structure 78 positioned adjacent the back surface 62 of the first back portion 56. A hole 80 is formed in the base structure 78. The hole 80 has a first portion 82 and a second portion 84. The second portion 84 has a diameter substantially similar to a diameter of the shaft 100 of the mushrooms 96. The first portion 82 has a diameter substantially similar to the diameter of the cylindrical member 104 of the mushroom 96. As can be seen in FIG. 8, the first portion 82 is positioned above the second portion 84. The base structure 78 and hole 80 can be formed of a continuous piece of material. Alternatively, the hole 80 and base structure 78 can be formed in the back surface 62 of the first back portion 56 by tool common in the art. The keyhole 60 can be independently of the first back portion 56 and can be attached to the back surface 62 of the first back portion 56 by screws that are inserted through the screw holes 83.

Figure 9:
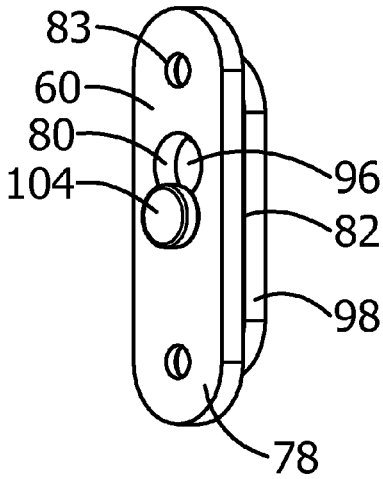
FIG. 9 shows a perspective view of the mushroom placed within the keyhole as used in the present invention.

Referring to FIG. 9, there is shown an isolated perspective view of the mushroom 96 placed in the keyhole 60. The length of the shaft 102 of the mushroom 96 is equal to a thickness of the base structure 78 of the keyhole 60 so that the cylindrical member 104 of the mushroom 96 can be inserted into the first portion 82 of the hole 80 and extend out of the base structure 78 so that the shaft 100 can then be moved into the second portion 84 of the hole 80. Once the shaft 100 resides within the second portion 84 of the hole 80, the base member 98 and cylindrical member 104 keep the shaft 100 from moving forwards and backwards while the mushroom 96 is engaged with the keyhole 60. To remove the mushroom 96, the mushroom 96 is raised upwardly relative to the keyhole 60 and the cylindrical member 104 is past through the first portion 82 of the hole 80 so as to remove the mushroom 96 from the keyhole 60.

The mushroom 96 and keyhole 60 relationship allows the front surface 94 of the second back portion 92 to positioned adjacent the back surface 62 of the first back portion 56 while the furniture assembly 10 is in the first position. The mushrooms 96 and keyholes 60 are not utilized while the furniture assembly 10 is in the second position.

Figure 10:
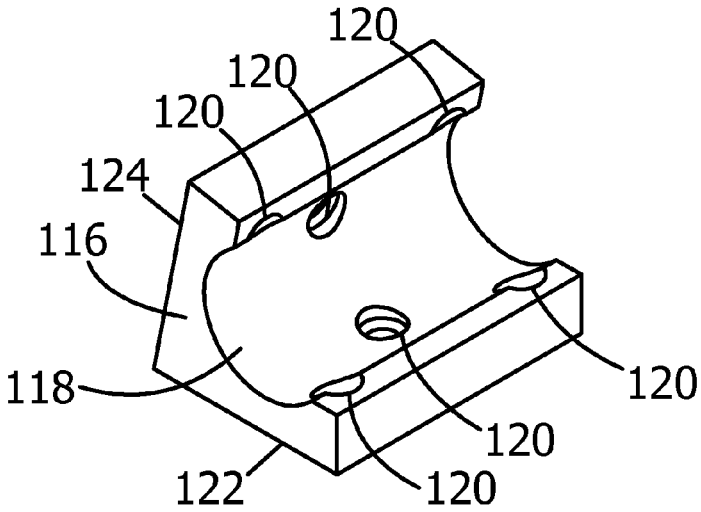
FIG. 10 shows an isolated perspective view of the notched part as used in the present invention.

Referring to FIG. 10, there is shown an isolated perspective view of the notched part 116 of the present invention. As described above in FIGS. 4 and 5, the notched part 116 has a receiving area 118 that receives the stoppers 32 and 40 of the second seat portion 26. Referring back to FIG. 10, the notched part 116 has a top wall 124 and a back wall 122. The notched part 122 is mounted to the furniture assembly of the present invention so that the top wall 124 is adjacent the leg 112 of the first back portion 56. The back wall 124 is adjacent the overhang 70 of the first back portion 56. Holes 120 are formed in the receiving area 118 of the notched part 116 so as to mount the notched part 116 to the leg 112 and overhang 70 with screws or any other appropriate means. The receiving area 118 is arcuate in shape so as to receive cylindrically-shaped stoppers 32 and 40. One notched part 116 is mounted on each side of the first back portion 56 so that a notched part 116 will receive each of the stoppers 32 and 40 of the second seat portion 26.

Figure 11:
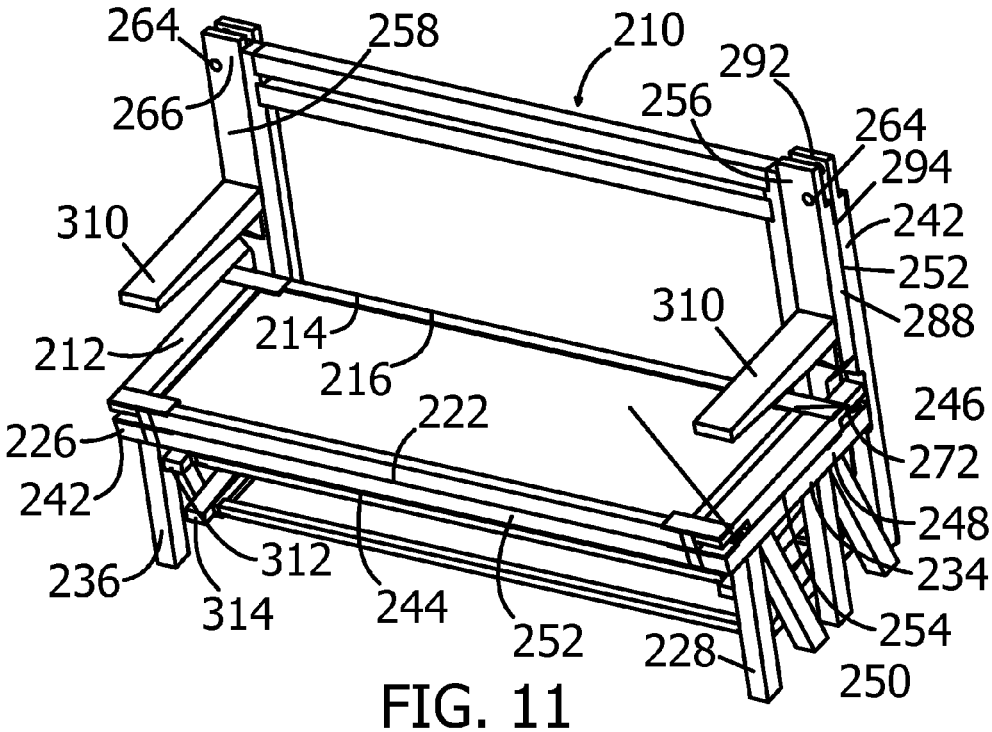
FIG. 11 shows a perspective view of another embodiment of the furniture assembly in the present invention in first position.

Referring to FIG. 11, there is shown a perspective view of another embodiment of the furniture assembly 210 in the present invention. The first seat portion 212, the second seat portion 226, first back portion 256, and the second back portion 292 have a width that is greater of similar portions in the preferred embodiment of the furniture assembly 10. The furniture assembly 210 functions as a sofa in the first position and a bed in the second position rather than a chair in the first position and a bed in the second position. The width of the first seat portion 212 and the second seat portion 226 and the first back portion 256 and the second back portion 292 can be made wider in the furniture assembly 210 by making solid pieces of the portions 212, 226, 256 and 292 wider than the corresponding portions 12, 26, 56 and 92 of the preferred embodiment 10. The portions 212, 226, 256, and 292 can also be made wider by telescoping the portions 12, 26, 56, and 92 of the preferred embodiment 10 laterally outwardly.

The structural members of the alternative embodiment of the furniture assembly 210 have similar relations to the structural members of the preferred embodiment of the furniture assembly 10. For example, the front surface 294 of the second back portion 292 is adjacent the back surface 252 of the first back portion 256. The leg 312 of the first back portion 256 is positioned above the leg 314 of the second back portion 292 when in the first position. The first back portion 256 has a first stopper 252 that is adjacent a projection 246 on the top surface 254 of the second seat portion 226.

The first seat portion 212 has a channel 214 formed in an end 216 thereof. A second seat portion 226 is positioned below the first seat portion 212. The first plurality of legs 228 extends from a bottom surface 244 of the second seat portion 226 adjacent the side 234 thereof. A second plurality of legs 336 extends from the bottom surface 244 of the second seat portion 226 adjacent an opposite side 242 thereof. The first back portion 256 is positioned adjacent the end 216 of the first seat portion 212. The first back portion 256 is received in the channel 214 of the first seat portion 212 when in the first position. A first pair of projections 246 extend upwardly from a top surface 254 of the second seat portion 226. The first pair of projections 246 are adjacent end 248. A second pair of projections 250 extend upwardly from the top surface 254. The second pair of projections 250 are adjacent the opposite end 252 of the second seat portion 226. A first stopper 272 is affixed to a side 288 of the first back portion 256. The stopper 272 is positioned between the first seat portion 212 and the second seat portion 226 so as to prevent an upward and downward movement of the first back portion 256. A pair of holes are formed in the front surface 258 of the first back portion 256 adjacent a top 266 thereof. A pair of arms 310 extend outwardly from the front surface 258 of the first back portion 256. Leg 312 extends outwardly from the first back portion 256. Leg 314 extends outwardly from the bottom of the second back portion 292. Leg 312 is positioned above the leg 314 when in the first position. The first plurality of legs 228 of the second seat portion 226 extend downwardly from a bottom surface 244 of the second seat portion 226 adjacent a side 234 thereof. A second plurality of legs 236 extend downwardly from the bottom surface 244 of the second seat portion 226 adjacent an opposite side 242 thereof.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. A furniture assembly reconfigurable between a first position and a second position comprising:

a seat assembly comprising first and second seat portions, the seat assembly defining a seat surface and comprising a first plurality of legs extending from a first side of the seat assembly, a second plurality of legs extending from a second side of the seat assembly, and first and second connectors;

a first back portion having a first support surface, a first back leg portion, and third, fourth, fifth, and sixth connectors; and a second back portion having a second support surface, a second back leg portion, and seventh, eighth, and ninth connectors; whereby the first, second, third, fourth, fifth, sixth, seventh, eighth, and ninth connectors may be disconnected to allow the seat assembly, the first back portion, and the second back portion to be detached from each other;

in the first position, the first connector engages the fourth connector to detachably attach the first back portion to the seat assembly, and the fifth connector engages the eighth connector and the sixth connector engages the ninth connector to detachably attach the second back portion to the first back portion such that the first and second support surfaces are not aligned with the seat surface, the first back leg portion is arranged under the seat surface of the seat assembly such that the first back leg portion does not support the furniture assembly, the second back leg portion is arranged under the seat surface of the seat assembly such that the second back leg portion does not support the furniture assembly, and the furniture assembly is supported in the first position by the first and second pluralities of legs extending from the seat assembly; and in the second position, the first connector engages the third connector to detachably attach the first back portion to the seat assembly, and the second connector engages the seventh connector to detachably attach the second back portion to the seat assembly such that the first and second support surfaces are substantially aligned with the seat surface, and the furniture assembly is supported by the first and second pluralities of legs extending from the seat portion and the first and second back leg portions.

2. The furniture assembly of claim 1, further comprising:

the fifth and sixth connectors are each formed by at least one keyhole formed in one of the first and second back portions; and the eighth and ninth connectors are each formed by at least one mushroom projection formed in the other of the first and second back portions; wherein the mushroom projections each engage at least one keyhole to secure the second back portion to the first back portion when the furniture assembly is in the first position.

3. The furniture assembly of claim 2, further comprising:

at least one seat projection formed on the seat assembly; and at least one back stopper formed in the first back portion; wherein the at least one seat projection engages the at least one back stopper to secure the first back portion to the seat assembly when the furniture assembly is in the first position.

4. The furniture assembly of claim 2, further comprising:

at least one overhang formed on the first back portion; and at least one leg stopper extending from at least one of the legs of the seat assembly; wherein the at least one leg stopper engages the at least one overhang to resist rotation of the first back portion relative to the seat assembly when the furniture assembly is in the first position.

5. The furniture assembly of claim 1, further comprising:

at least one seat projection formed on the seat assembly; and at least one back stopper formed in the first back portion; wherein the at least one seat projection engages the at least one back stopper to secure the first back portion to the seat assembly when the furniture assembly is in the first position.

6. The furniture assembly of claim 5, further comprising:

at least one overhang formed on the first back portion; and at least one leg stopper extending from at least one of the legs of the seat assembly; wherein the at least one leg stopper engages the at least one overhang to resist rotation of the first back portion relative to the seat assembly when the furniture assembly is in the first position.

7. The furniture assembly of claim 1, further comprising:

at least one overhang formed on the first back portion; and at least one leg stopper extending from at least one of the legs of the seat assembly; wherein the at least one leg stopper engages the at least one overhang to resist rotation of the first back portion relative to the seat assembly when the furniture assembly is in the first position.

8. The furniture assembly of claim 1, in which at least one of the first, second, third, fourth, fifth, sixth, seventh, eighth, and ninth connectors is formed by a pair of connecting structures.

9. The furniture assembly of claim 1, in which the first, second, third, fourth, fifth, sixth, seventh, eighth, and ninth connectors are each formed by pairs of connecting structures.

10. The furniture assembly of claim 1, in which the first back assembly further comprises an arm portion, where the arm portion is arranged above the seat surface when the furniture assembly is in the first position.

11. The furniture assembly of claim 10, in which the arm portion supports the furniture assembly when the furniture assembly is in the second position.

12. The furniture assembly of claim 1, in which:

the first and second plurality of legs extend from the first seat portion; and the second portion is detachably attached to the first seat portion to form the first and second connectors.

13. The furniture assembly of claim 1, in which:

the first connector is formed at least in part by a first projection extending from one of the first and second seat portions;

the second connector is formed at least in part by a second projection extending from one of the first and second seat portions;

the third connector is formed at least in part by a first hole formed in the first back portion; and the seventh connector is formed at least in part by a second hole formed in the second back portion; wherein the first projection extends through the first hole when the first connector engages the third connector; and the second projection extends through the second hole when the second connector engages the seventh connector.

* * * * *